United States Patent [19]

Lahm

[11] 4,407,011

[45] Sep. 27, 1983

[54] INTEGRATED LIGHTING SYSTEMS FOR SUSPENDED CEILINGS OR THE LIKE

[75] Inventor: Albert H. Lahm, Lorain, Ohio

[73] Assignee: Donn Incorporated, Westlake, Ohio

[21] Appl. No.: 214,172

[22] Filed: Dec. 8, 1980

[51] Int. Cl.[3] ..... F21S 1/02

[52] U.S. Cl. ..... 362/150; 362/217; 362/225; 362/290; 362/292; 362/249; 362/404; 362/408

[58] Field of Search ..... 362/150, 217, 225, 290, 362/249, 404, 408, 292

[56] References Cited

U.S. PATENT DOCUMENTS 3,334,568 8/1967 Morrison ..... 362/150 X
4,086,480 9/1976 Lahm ..... 362/148

*Primary Examiner*—Stephen J. Lechert, Jr.
*Attorney, Agent, or Firm*—Pearne, Gordon, Sessions, McCoy & Granger

[57] ABSTRACT

In an integrated suspension ceiling it is disclosed in which a fluorescent tube type lighting fixture is supported from an directly over a runner forming a part of the grid of the ceiling system. The runner is provided with a central web and oppositely extending flanges extending from the sides of the web. The web is formed with an opening above which the lighting fixture is supported. The lighting fixture includes a ballast frame separately supported on the runner above the opening, a reflector positioned in the opening below the ballast frame supported directly on the runner and a louver mounted within the opening flush with the plane of the ceiling. Each of the frame, reflector and louver are separately supported and removable from the runner for installation and service. Because the lighting fixture is supported directly on the runner and is removably attached thereto, the lighting fixture can be installed after the grid is installed. The fixture does not provide an interruption in the ceiling system. Therefore, fixtures can be conveniently located where relatively high levels of light intensity are required without requiring excessive lighting in areas where lower lighting levels are acceptable.

17 Claims, 5 Drawing Figures

INTEGRATED LIGHTING SYSTEMS FOR SUSPENDED CEILINGS OR THE LIKE

BACKGROUND OF THE INVENTION

This invention relates generally to suspension ceiling systems, and more particularly to an integrated ceiling system in which novel and improved, separate lighting fixtures or the like are supported on the grid runs and to a novel and improved combination of such lighting fixture and a grid-supported ceiling system.

Prior Art

It is known to provide lighting fixtures in grid-type suspended ceiling systems. In most of such systems, however, the lighting fixture is positioned in an opening within the grid of the same size as the remaining panel openings, or the grid is constructed to provide an opening especially sized to receive the fixture. In other instances, the lighting fixture itself is constructed to form a portion of the grid. Examples of such systems are illustrated in U.S. Pat. Nos. 2,376,715; 2,888,113; 3,334,568; 3,343,310, 3,397,499; 3,512,313; 3,835,614; and 4,086,480.

When such lighting fixtures are positioned in a full panel opening, the fixtures are usually relatively large and expensive. When the grid is modified to provide openings especially sized to receive a fixture, additional complications and expense are normally encountered. Further, in such cases, partial panels must often be provided and panel scrap is often encountered. When the fixture is constructed to constitute part of the grid, the fixture cost is usually relatively high, and it is frequently necessary to use more expensive electrical trades to construct the entire ceiling.

SUMMARY OF THE INVENTION

The present invention provides an integrated suspension ceiling structure, in which a grid of the general configuration illustrated in U.S. Pat. No. 3,835,614 (assigned to the assignee of the present invention) is combined in a novel and improved system in which a separate lighting fixture is mounted on the grid runner above an opening therein. In such system, the entire grid can be installed by workmen usually employed for grid installation, and the lighting fixtures are then easily installed at the desired positions within the grid by the electrical trades or the like.

The runners on which the fixtures are mounted are provided with spaced and oppositely extending flanges and a recessed central web. At locations where the lighting fixtures are desired, the web is provided with an elongated opening.

In accordance with the illustrated embodiment of this invention, a wiring and ballast channel-shaped housing of the lighting fixtures is removably mounted on the runner at a location above the opening. A separate reflector is removably mounted in the opening below the channel and is structured to efficiently direct the light through the opening to the area below the ceiling. The tube light is recessed above the runner and, since the opening is relatively narrow, is concealed to a considerable extent from the side. Therefore, the brightness of the light source is not objectionably evident. When desired, a separate louver is removably mounted below the opening, which further conceals the light tube and provides an attractive, finished appearance to the fixture. Such louver is preferably arranged so that its lower surface does not extend below the ceiling plane, so that it does not appear as an interruption in the ceiling surface.

The fixture is sized to have a width which is not greater than the width of the runner on which it is mounted and is located within the vertical boundaries of the runner. It does not require the use of extra grid members, and does not require special panel sizes. Therefore, no panel scrap results from the presence of the fixture. The overall ceiling geometry and appearance are not materially affected by the presence of the lighting fixture. Therefore, lighting fixtures can be provided at random locations where lighting is required without producing an undesirable discontinuity in the ceiling appearance. This feature is particularly desirable in open area work spaces, since it allows the fixture to be positioned at locations where work lighting is required without requiring excessive high light levels in the entire area.

Further, when the invention is combined with the ceiling grid system of the type disclosed and claimed in the copending application Ser. No. 232,195, filed Feb. 6, 1981 the fixture can be moved from one location to another within an existing ceiling grid without difficulty.

Still further, the illustrated structure can be easily serviced. For example, if the ballast must be replaced, the louver, lamp, and reflector can be easily removed providing access to the housing cover so that the electrical system is accessible through the opening from the room below. Alternativley, adjacent panels can be removed to permit direct access for the servicing of the fixture or removal and replacement of the entire channel-shaped frame if desired.

With this invention, a low-cost, attractive lighting system is provided which is economical to install and service. These and other aspects of this invention are more fully described in the following description and in the drawings.

DETAILED DESCRIPTION OF THE PREFERRED EMBODIMENTS

Figure 1:
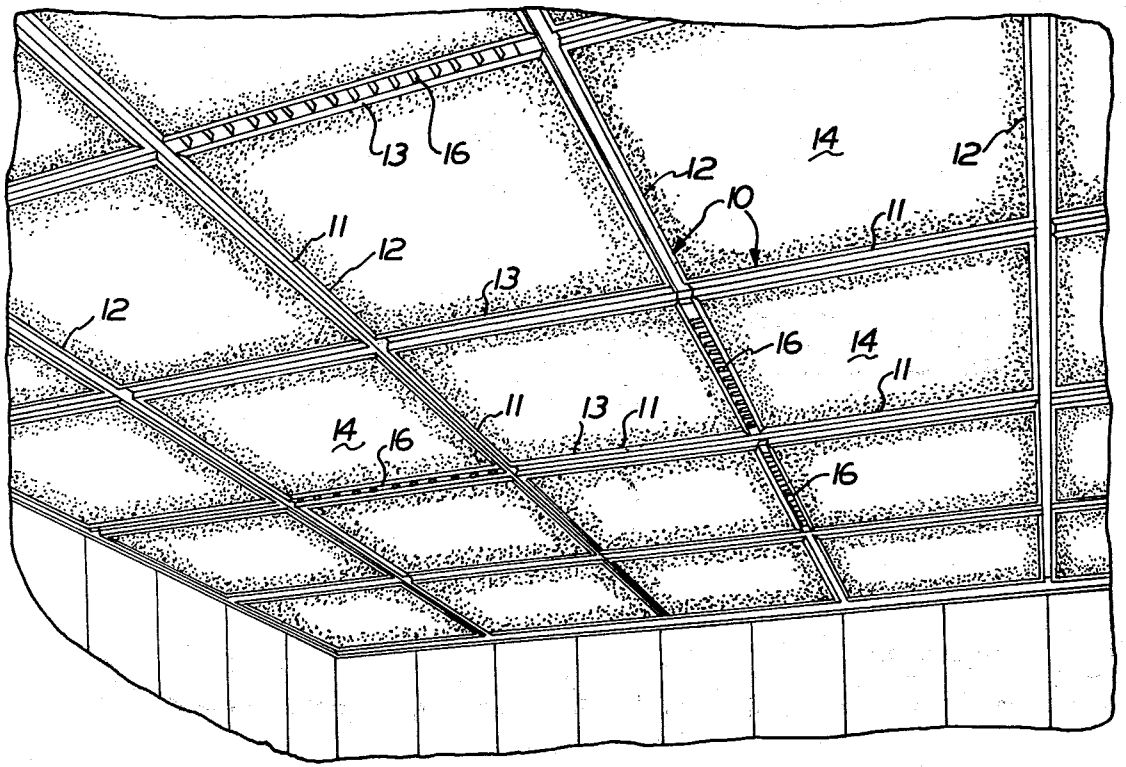
FIG. 1 is a perspective view of a portion of a suspension ceiling incorporating the present invention.

FIG. 1 illustrates a portion of a typical ceiling system in accordance with the present invention. In such system, a grid 10 includes a plurality of runners or grid members 11 interconnected to provide a plurality of first runs 12 which extend in one direction along the ceiling parallel to each other and second runs 13 which extend substantially perpendicular to the first runs and parallel to each other. In the illustrated embodiment, the first and second runs 12 and 13 respectively cooperate to define a plurality of grid spaces in which ceiling panels 14 are positioned and supported. In the illustrated embodiment, the grid spaces are square so that the panels 14 are also square. It should be understood, however, that the grids can be constructed to provide grid spaces which are rectangular or the like, and that truncated pyramid panel systems as illustrated in U.S. Pat. No. 3,835,614 may also be installed.

Located within the grid at substantially any desired location are accessories 16 which may be lighting fixtures as described in detail below or other types of accessories, for example, air boots or the like. As described in more detail below, the various accessories 16 can be located at substantially any desired location within the grid system of the ceiling structure, and when the grid is constructed as described and illustrated in the copending application, supra, the accessories 16 can be removed, moved, or installed at substantially any location within an existing grid system.

Figure 2:
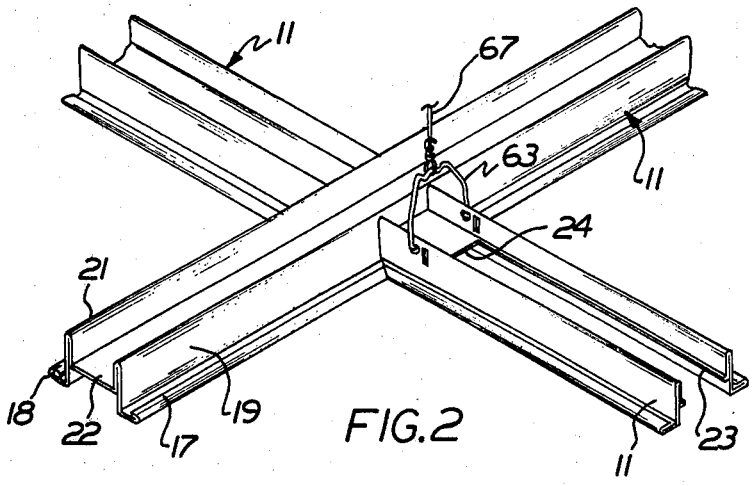
FIG. 2 is a fragmentary, perspective view of an intersection between the runners of a grid system illustrating one grid runner with an opening above which a fluorescent lighting fixture in accordance with the present invention is subsequently mounted.

Referring to FIG. 2, the illustrated grid members 11 are provided with the illustrated cross section, for example, by bending a strip of metal or the like. Such grid members include spaced and oppositely extending flanges 17 and 18 which respectively join at their inner edges with a vertically extending wall 19 and 21. Interconnecting the walls and maintaining proper spacing therebetween is a horizontally extending, elongated web 22. In the illustrated embodiment, the web 22 is recessed above the flanges 17 and 18. However, in its broader aspects, this invention is not limited to such an arrangement.

The cross section illustrated in FIG. 2 is substantially the same cross section as one of the grid runners illustrated in U.S. Pat. No. 3,835,614, supra, and such grid runners may be, if desired, constructed and connected in a basket weave grid system as disclosed in detail in copending application, supra.

At locations where an accessory 16 is required, the grid member 11 is provided with an elongated opening 23 in the web 22 having a width slightly less than the width of the web 22 and a length appropriate for the accessory to be installed. In the illustrated embodiment, the end 24 of the opening 23 is spaced from the junction with the adjacent perpendicularly extending grid member 11 and the opening is preferably centered within the span of the grid member in which it is formed.

Figure 3:
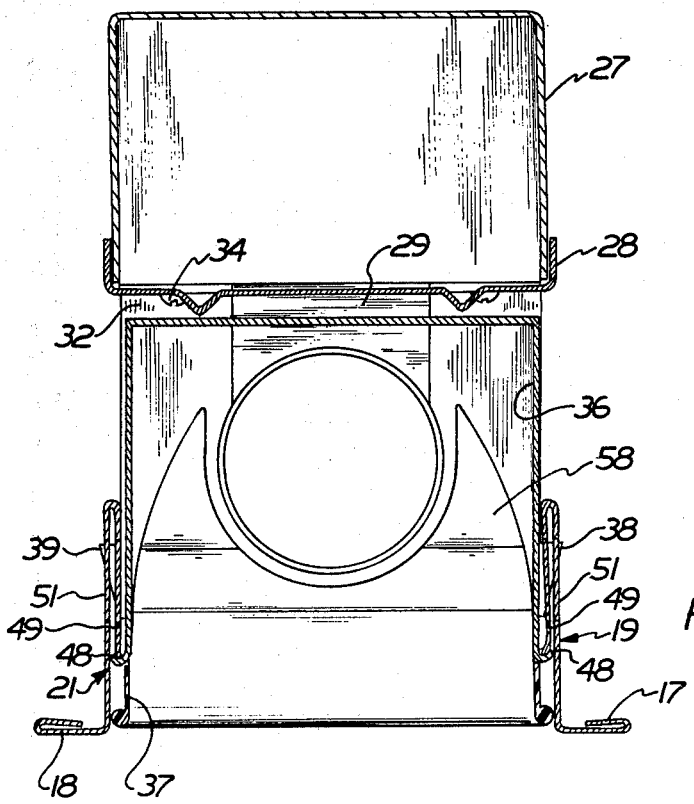
FIG. 3 is a lateral cross section of a grid runner with a lighting fixture mounted thereon.
Figure 4:
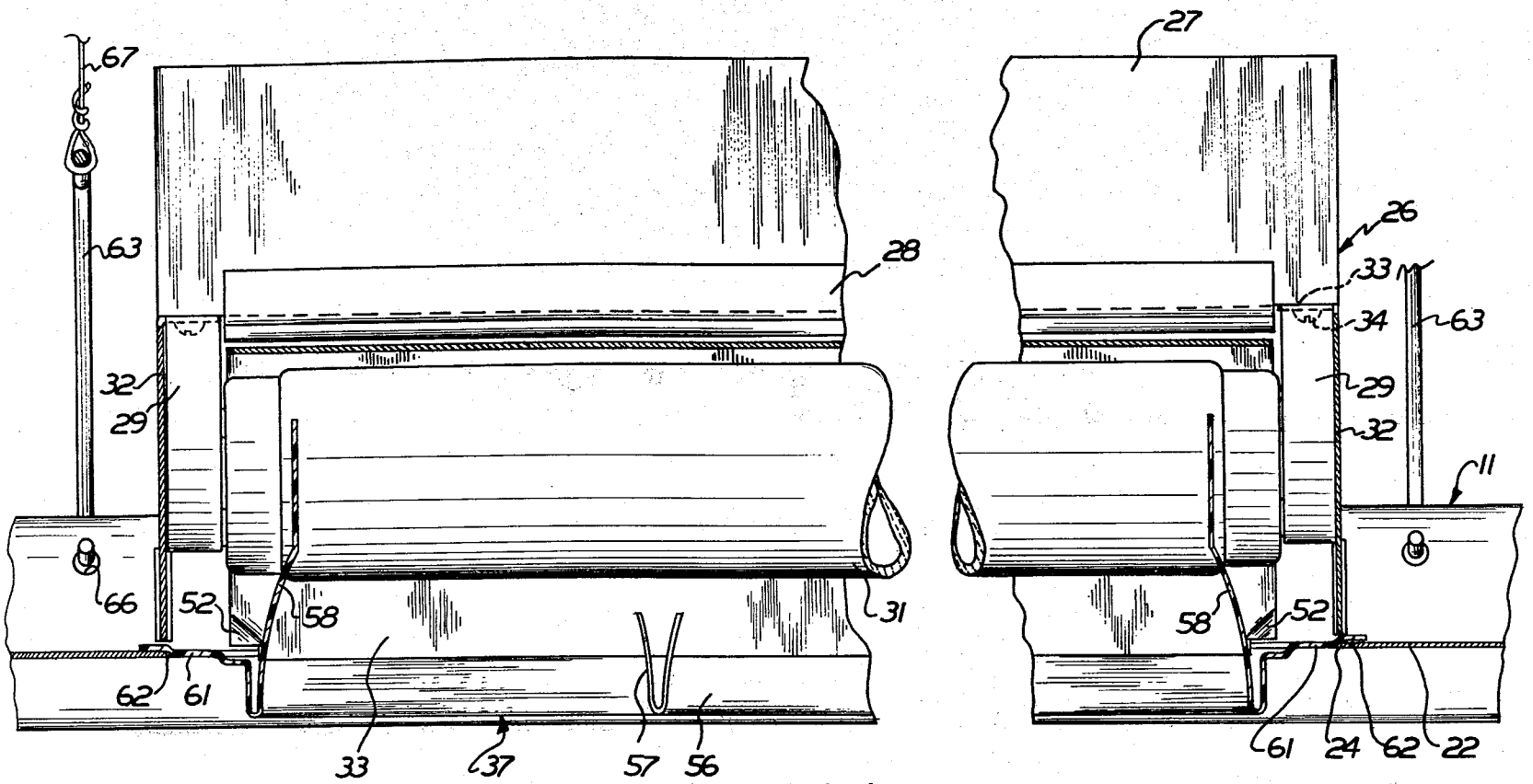
FIG. 4 is a broken side elevation, partially in section, illustrating the runner and lighting fixture combination.
Figure 5:
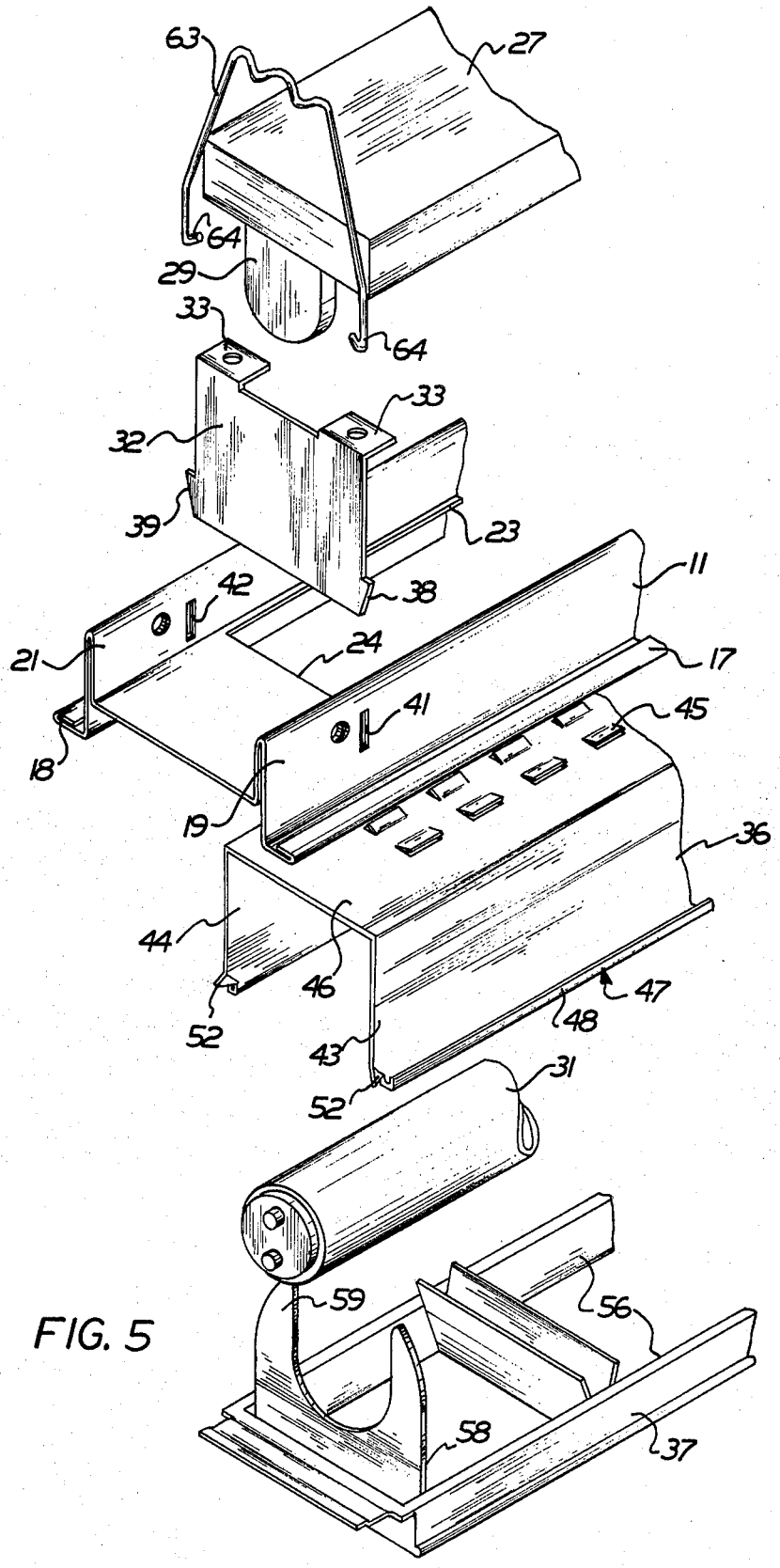
FIG. 5 is an exploded, fragmentary, perspective view of the various elements of the lighting fixture and the supporting grid.

Referring now to FIGS. 3 through 5, a lighting fixture in accordance with the present invention is illustrated, installed both at an opening 23 within a grid member 11 and in a disassembled, exploded condition. The illustrated fixture 26 is a fluorescent lighting fixture which is removably mounted on the associated grid member 11. This fixture includes a channel-shaped housing 27 which encloses the ballast and wiring of the fixture. The housing 27 is closed along its lower side by a ballast cover 28 which is removably installed on the housing.

Mounted on each end of the housing 27 is a socket member 29 in which the ends of a fluorescent light tube 31 are removably mounted. Also secured to the ends of the channel housing 27 are a pair of similar but opposite mounting clips 32. Such mounting clips 32 are provided with laterally extending tabs 33 through which screws 34 extend to secure the clips on the housing 27. As discussed in more detail below, these clips provide means for removably supporting the housing 27 on the associated grid member 11 at a location spaced above the opening 23 therein.

The fixture also includes a separate reflector 36 which is removably mounted on the grid member 11 at a position in which it extends around the light tube 31 and between the light tube 31 and the housing 27.

When a more finished appearance is desired, a louver 37 is installed on the grid member 11 immediately below the opening 23 therein. In some instances in which cost considerations dictate, a louver 37 is not provided with the fixture.

The mounting clip 32 is formed with oppositely extending projections 38 and 39 adjacent to its lower edge, which are sized to extend into vertically extending, elongated openings 41 and 42, respectively, formed in the vertical walls 19 and 21, respectively. When positioned in the openings 41 and 42, the projections 38 and 39 lock the mounting clips on the grid member and serve to support the channel housing 27 in a fixed location in alignment with and spaced above the opening 23.

Preferably, the projections 38 and 39 are formed with extremities which are inclined inwardly toward the lower edge of the clip to provide camming surfaces which facilitate the insertion of the projections into the installed position. Such camming action causes the vertical walls 19 and 21 to be resiliently spread apart as the clip is moved down to the respective openings, and then the resiliency of the grid member causes the vertical walls 19 and 21 to spring back into their original position when the projections 38 and 39 are in alignment with their respective openings, causing the projections to extend into the openings. Removal of the clip is accomplished by manually spreading the upper edges of the vertical walls 19 and 21 until the projections move clear of the openings and allow disassembly or removal of the clip from its mounted position. With this simple structure, it is possible to removably install the fixture housing 27 in proper position above the opening, where it is independently supported by the grid member 11.

The reflector 36 is preferably formed of sheet metal, such as polished aluminum, and is constructed to permit it to be installed by vertical insertion up through the opening 23. The illustrated reflector is substantially rectangular in shape having vertical walls 43 and 44 joined at their upper ends by a horizontally extending wall 46. Ventilation slots 45 may be provided in the top of the reflector above the tube 31. It should be understood, however, that other reflector shapes can be utilized. The illustrated reflector shape tends to efficiently reflect light from the light tube 31 down through the opening 23 to the room below, and is preferred in combination with a fluorescent-type light tube because of its efficient operation. When a more focused type light pattern is desired, however, other shapes such as parabolic shapes may be utilized.

Extending along the lower edges of the walls 43 and 44, the reflector is formed with an upwardly open channel 47 providing a lip 48 proportioned to extend up between adjacent portions 49 and 51 of the vertical walls 19 and 21, respectively, as best illustrated in FIG. 3. This structure locks the lower side edges of the reflector against inward movement when the reflector is installed. The channels 47 terminate at a location spaced back from the ends of the reflector and the ends are provided with laterally extending tabs 52, best illustrated in FIG. 5, which snap over the web portion adjacent the opening 23 to lock the reflector in its installed position when it is inserted up through the opening 23 to such position. Removal of the reflector, however, is accomplished by releasing the tabs 52 by springing them back clear of the edges of the opening.

The louver 37 is provided with side rails 56 extending the length of the louver and supporting the ends of louver slats 57 spaced at intervals along the length of the louver. Adjacent to each end of the louver 37 is an upwardly extending wall 58 having a shape best illustrated in FIGS. 4 and 5. This wall operates to conceal the ends of the tube 33 and is formed with a notch 59 adapted to receive the lower side of the tube 31. This wall provides a finished end appearance on the fixture by concealing the tube ends and the end of the reflector along with the socket 21 and clip 32. The louver 37 is removably mounted in the opening by a tongue 61 formed at each end of the louver, which fits up over the web 22 at the end 24 of the opening 23. Each tongue is preferably formed with a step at 62 to axially locate the louver in the installed position. The louver may be formed of any suitable material and, for example, may be molded from plastic or fabricated from sheet metal.

Support clips 63 formed of wire having inturned hooked ends 64 are preferably provided to support the grid member, and in turn the fixture, at each end of the fixture. Such ends 64 extend through openings 66 formed in the vertical walls 19 and 21 of the grid member adjacent the ends of the opening 23. These clips can be supported by suitable wire 67 from the building structure. It should also be noted that similar clips may be used at regular intervals to support the entire grid. Since the fixture elements are supported on the runner at the ends of the opening, and since the runner is supported adjacent to such ends, the center span of the runner is not excessively loaded.

The preferred method of installing fixtures in a grid in accordance with this invention is as follows. The various grid members 11 forming the grid are installed in the usual way by personnel normally used for such installation. Grid members 11 having openings 23 therein are provided within a grid at the locations where lighting fixtures are desired, and where other types of accessories compatible with the openings, such as air boots or the like, are required. The clips 32 are installed on the housing 27 and the housing is then snapped into place above the associated opening 23. After the installation of the housing, the reflector 36 is pressed up into the opening to its installed position. The sequence of installation of the housing and the reflector, however, can be reversed if desired. The fixture may be wired prior to or after installation.

After the housing and reflector are installed, the bulb 31 is mounted and the fixture is operative. In many instances where cost considerations dictate the use of fixtures which do not include the louver 37, the installation of the fixture is thus completed and the adjacent panels are installed within the grid in the usual manner. Because the illustrated opening is relatively narrow, having a width less than twice the diameter of the tube, in the illustrated embodiment, and because the tube is received above the ceiling plane, the light tube is obscured from the side and the brightness of the light source is not objectionably evident.

In instances in which the louver is desired to provide a more finished appearance and to reduce the tendency for objectionable brightness of light source to exist, the louver is slipped into place below the reflector and tube. Its installation is accomplished by first inserting one tongue over the web at one end of the opening a sufficient distance to allow the movement of the tongue at the other end up through the opening. The louver is then shifted longitudinally to its proper position, where it is maintained in position by the step formed in the two tongues.

Because the light is recessed above the ceiling level, it is not objectionably evident from the side even when a louver is not installed. Further, when a louver is used, the louver acts to reduce any objectionable brightness when the fixture is viewed from a location within the room in alignment with the tube.

Preferably, the louver is dimensioned so that it does not extend below the plane of the ceiling and is dimensioned so that its lower surfaces are substantially flush with the ceiling plane.

If it becomes necessary to service the fixture, the servicing can be easily accomplished. If desired, the louver, bulb, and reflector can be easily removed to provide direct access for removal of the ballast cover through the opening. Alternatively, adjacent panels can be lifted clear, providing access to the fixture from above the grid. Further, if it is desired to remove and/or replace the entire fixture, the fixture can be easily disassembled by reversing the installation procedure. In addition, when a fixture in accordance with this invention is combined with a grid in accordance with copending application, supra, it is a simple matter to move the fixture and the associated grid member to another location within the grid, replacing the apertured grid with a grid member having a full web.

With the present invention, lighting within the grid system is provided without producing any substantial discontinuity in the appearance of the ceiling in which the fixture is installed. This is particularly desirable in open area work spaces, since it permits the installation of lighting fixtures in the areas where lighting is required without requiring excessive numbers of fixtures in zones in which lower levels of lighting are acceptable.

Because the fixture is easily mounted on the grid member after the grid is installed, workmen normally used to install the grid and ceiling panels are used for such installation work. The only work requiring the electrical trades is the actual installation of the fixture. This often results in savings in cost of labor when compared to systems in which the fixture itself constitutes part of the grid.

Although the preferred embodiment of this invention has been shown and described, it should be understood that various modifications and rearrangements of the parts may be resorted to without departing from the scope of the invention as disclosed and claimed herein.

I claim:

1. An integrated ceiling comprising a support grid defining a plurality of grid spaces adapted to receive ceiling panels which cooperate with the grids to provide a finished ceiling, said grids including runners, at least some of said runners having spaced and opposed panel support flanges and a horizontally extending web between said flanges, an elongated opening in said web, and a separate tube-type lighting fixture supported on said runner at said opening, said fixture including an elongated tube light above said opening.

2. An integrated ceiling as set forth in claim 1, wherein said fixture is detachably supported on said runner.

3. An integrated ceiling as set forth in claim 1, wherein said fixture is a fluorescent fixture having a wiring frame mounted on said runner and spaced above said opening, a fluorescent light tube mounted below said frame and above said opening, and an elongated reflector extending from said opening and around said tube to direct light through said opening.

4. An integrated ceiling as set forth in claim 3, wherein said reflector is removably supported on said runner and is removable through said opening without removing said frame.

5. An integrated ceiling as set forth in claim 4, wherein a louver is removably mounted below said tube.

6. An integrated ceiling as set forth in claim 3, wherein a louver is removably mounted on said runner below said web.

7. An integrated ceiling as set forth in claim 6, wherein said web is recessed above said flanges and the lower side of said louver is substantially coplanar with said flanges.

8. An integrated ceiling as set forth in claim 1, wherein said grid includes separate runners some of which having said openings and others of which having a substantially continuous web.

9. An integrated ceiling as set forth in claim 1, wherein said lighting fixture includes a tube having a diameter at least equal to one-half the width of said opening.

10. A tube-type lighting fixture for a grid supported suspension ceiling having apertured unitary grid members therein comprising an elongated frame adapted to be removably mounted on said unitary grid member within an existing grid, and a separate reflector adapted to be mounted on said unitary grid member within said existing grid, each of said frame and reflectors being adapted to be separately removed from said existing grid, said frame being provided with clips at each end operable to removably connect said frame to an existing grid system and to position said frame directly above an apertured grid member.

11. A tube-type lighting fixture as set forth in claim 10, wherein said reflector is adapted to be mounted below said frame in an aperture within said apertured grid member.

12. A tube-type lighting fixture as set forth in claim 11, wherein a separate louver is adapted to be removably mounted in an aperture in said apertured grid member below said reflector.

13. A tube-type lighting fixture as set forth in claim 10, wherein a separate louver is adapted to be removably mounted on said apertured grid member below said reflector.

14. A method of constructing a suspended ceiling comprising forming elongated grid members sufficiently wide to allow for an opening through which light can pass to an area below the ceiling, forming such openings in some of said grid members, assembling and installing said grid members in a grid with the members having openings therein installed where light fixtures are required, and thereafter mounting light fixtures on said grid above said openings and installing ceiling panels in said grid.

15. A method as set forth in claim 14, including forming said openings as elongated openings extending lengthwise of said some of said grid members, installing a tube-type lighting fixture mounted with a tube light above said opening and extending substantially parallel thereto.

16. A method as set forth in claim 15, including forming said grid members with integral spaced and oppositely extending panel support flanges and a central web, and forming said openings in said central web.

17. A method as set forth in claim 16, including forming said grid members with said web recessed above said flanges and including the step of installing a louver beneath said web and substantially flush with said flanges.

* * * * *